US008978562B2

(12) United States Patent
Nagamine et al.

(10) Patent No.: US 8,978,562 B2
(45) Date of Patent: Mar. 17, 2015

(54) RAIL GUIDED VEHICLE SYSTEM

(75) Inventors: Shohei Nagamine, Ise (JP); Masahiro Hirata, Ise (JP)

(73) Assignee: Murata Machinery, Ltd., Kyoto (JP)

( * ) Notice: Subject to any disclaimer, the term of this patent is extended or adjusted under 35 U.S.C. 154(b) by 0 days.

(21) Appl. No.: 14/117,951

(22) PCT Filed: Apr. 12, 2012

(86) PCT No.: PCT/JP2012/059975

§ 371 (c)(1),
(2), (4) Date: Dec. 12, 2013

(87) PCT Pub. No.: WO2012/157378

PCT Pub. Date: Nov. 22, 2012

(65) Prior Publication Data

US 2014/0090575 A1 Apr. 3, 2014

(30) Foreign Application Priority Data

May 16, 2011 (JP) ..... 2011-109715

(51) Int. Cl.

| | |
|---|---|
| ***B66C 7/02*** | (2006.01) |
| ***E01B 7/00*** | (2006.01) |
| ***B61B 13/04*** | (2006.01) |
| ***E01B 25/22*** | (2006.01) |
| ***E01B 25/00*** | (2006.01) |
| ***E01B 25/26*** | (2006.01) |

(52) U.S. Cl.

CPC . *E01B 7/00* (2013.01); *B61B 13/04* (2013.01); *E01B 25/22* (2013.01); *E01B 25/00* (2013.01); *E01B 25/26* (2013.01)

USPC ..... 104/91

(58) Field of Classification Search

CPC ..... B66C 7/02; B66C 9/06; E01B 7/00; E01B 25/00; E01B 25/22; E01B 25/26; B61B 13/04

See application file for complete search history.

(56) References Cited

U.S. PATENT DOCUMENTS

| | | | | |
|---|---|---|---|---|
| 6,220,173 | B1 * | 4/2001 | Sauerwein | 104/130.01 |
| 6,308,818 | B1 * | 10/2001 | Bonora et al. | 198/465.1 |
| 8,770,111 | B2 * | 7/2014 | Yamamoto et al. | 104/89 |
| 8,813,653 | B2 * | 8/2014 | Izumi et al. | 104/130.07 |
| 8,826,825 | B2 * | 9/2014 | Shibata et al. | 104/89 |
| 8,869,707 | B2 * | 10/2014 | Kawauchi et al. | 105/72.2 |
| 2007/0163461 | A1 * | 7/2007 | Shiwaku | 104/89 |

(Continued)

OTHER PUBLICATIONS

Official Communication issued in International Patent Application No. PCT/JP2012/059975, mailed on Jul. 17, 2012.

(Continued)

*Primary Examiner* — Jason C Smith

(74) *Attorney, Agent, or Firm* — Keating & Bennett, LLP

(57) ABSTRACT

A rail guided vehicle system includes a rail that includes a first main rail, a second main rail, and a connection rail, and vehicles. Each vehicle includes a diverging roller supporting member that supports a pair of first and second diverging rollers such that the first and second diverging rollers shift, and a position stabilizing roller supporting member that supports position stabilizing rollers such that the position stabilizing rollers do not shift. The rail includes a first diverging guide configured to guide the first diverging roller, a second diverging guide configured to guide the second diverging roller, and a position stabilizing roller guide configured to guide the position stabilizing rollers in the no-guide zone where the diverging guide is absent.

10 Claims, 18 Drawing Sheets

(56) References Cited

U.S. PATENT DOCUMENTS

| | | | | |
|---|---|---|---|---|
| 2008/0127851 | A1 | 6/2008 | Kyutoku | |
| 2010/0242784 | A1* | 9/2010 | Oguro et al. | 104/130.01 |
| 2013/0269564 | A1* | 10/2013 | Yoo et al. | 104/91 |
| 2014/0090575 | A1* | 4/2014 | Nagamine et al. | 104/91 |
| 2014/0190366 | A1* | 7/2014 | Mukai et al. | 104/130.01 |
| 2014/0238260 | A1* | 8/2014 | Conte et al. | 104/130.01 |

OTHER PUBLICATIONS

English translation of Official Communication issued in corresponding International Application PCT/JP2012/059975, mailed on Dec. 5, 2013.

* cited by examiner

RAIL GUIDED VEHICLE SYSTEM

BACKGROUND OF THE INVENTION

1. Field of the Invention

The present invention relates to a rail guided vehicle system that conveys, along a rail, an article such as a container, in which various kinds of substrates for the production of semiconductor apparatuses, etc., are contained.

2. Description of the Related Art

A conventional rail guided vehicle system is known to be a rail guided vehicle system that conveys an article such as a FOUP (Front Opening Unified Pod) and that includes an overhead hoist transport (so-called OHT) travelling on a rail arranged on a ceiling.

Since such a rail guided vehicle system is often used in a clean room, where the cost of space is expensive, it is necessary to make the rail guided vehicle system smaller. One suggested technique is to make the rail guided vehicle system smaller by shortening the length of a connection rail that connects two main rails. For example, a known technique is to include a forcing guide, configured to force a diverging roller that is used when travelling on the connection rail to shift on the connection rail, in order to shorten the length of the connection rail. See, for example, Japanese Laid-Open Patent Application No. 2008-126743.

Here, the case where the vehicle travelling on a N-shaped rail moves from a rail on which the vehicle is travelling, to another rail is considered as an example. First, the vehicle shifts a diverging roller mechanism to the side on which another rail exists. The diverging roller mechanism is arranged in a travelling unit of the vehicle. Then, the vehicle is guided by a diverging guide, which extends from the rail to the middle of a connection rail, and moves to the connection rail. After this, the diverging roller mechanism is shifted to the opposite side in order for the vehicle to be guided by another diverging guide at the merging side. Here, another diverging guide is arranged in the connection rail and at the position opposite to the diverging guide, with a predetermined offset in between (separating area). In this situation, a forcing guide, which is arranged in the separating area, forces the diverging roller mechanism to be shifted toward another diverging guide. Thus, the travelling unit of the vehicle is guided to another rail.

In the above-mentioned technique, the diverging roller mechanism can only be shifted in the separating area, where the diverging guide does not exist. However, even if the forcing guide is used, the length of the separating area needs to be equal or greater than the length that is derived by adding the length of one diverging roller mechanism along the travelling direction, to the travelling length in which the vehicle travels during shifting the diverging roller mechanism.

For example, in order to shorten the connection rail, it is necessary to shorten the separating area by shortening the length of the forcing guide in the travelling direction. However, when shortening the length of the forcing guide, the diverging roller needs to be shifted rapidly unless the vehicle is slowed down. Shifting the diverging roller rapidly might cause abnormal operation because a large amount of stress is applied to the diverging roller. In addition, since the impulsion generated when the diverging roller abuts the forcing guide is large, the vibration of the vehicle and the damage of the diverging roller may occur.

As described above, the conventional technique has a limited benefit even if the connection rail can be shortened, and the conventional technique has a technical problem of causing various disadvantages when attempting to shorten the connection rail further.

SUMMARY OF THE INVENTION

In view of the above, preferred embodiments of the present invention provide a rail guided vehicle system that is made smaller by effectively shortening the connection rail.

A rail guided vehicle system according to a preferred embodiment of the present invention is a rail guided vehicle system that includes a rail and vehicles. The rail includes a first main rail, a second main rail, and a connection rail that connects the first main rail to the second main rail.

The vehicles travel while being supported and guided by the rail. A vehicle includes a travelling unit, a diverging roller supporting member, and a position stabilizing roller supporting member. The travelling unit is configured to travel on the rail. The diverging roller supporting member is arranged in the travelling unit. The diverging roller supporting member supports a first diverging roller, and a second diverging roller, that are arranged with a gap in between in a width direction of the travelling unit. The first diverging roller and the second diverging roller shift in the width direction of the travelling unit.

The position stabilizing roller supporting member is arranged in the travelling unit. The position stabilizing roller supporting member supports position stabilizing rollers. The position stabilizing rollers are configured to stabilize a travelling position of the travelling unit such that the position stabilizing rollers do not shift in the width direction of the travelling unit.

The rail includes a first diverging guide, a second diverging guide, and a position stabilizing roller guide. The first diverging guide extends, on one side of the connection rail in the width direction of the connection rail, from the first main rail along an extending direction of the connection rail. The first diverging guide is configured to guide the first diverging roller.

The second diverging guide extends, on another side of the connection rail in the width direction of the connection rail, to the second main rail along the extending direction of the connection rail while having a no-guide zone that does not overlap with the first diverging guide in the extending direction of the connection rail. The second diverging guide is configured to guide the second diverging roller.

The position stabilizing roller guide is arranged in the no-guide zone. The position stabilizing roller guide is configured to guide the position stabilizing rollers in the no-guide zone. Here, the width direction of the travelling unit indicates the direction crossing the travelling direction of the vehicle.

According to a preferred embodiment of the present invention, the position stabilizing roller guide configured to guide the position stabilizing rollers is arranged in the no-guide zone. The no-guide zone is where the diverging guide of the rail is not provided. By arranging such a position stabilizing roller guide in the no-guide zone, the position stabilizing roller is guided by the position stabilizing roller guide, and thus the position of the vehicle is stabilized.

If the position of the vehicle is stabilized in the no-guide zone, the no-guide zone can be extended to the zone where the first diverging guide and the second diverging guide should be arranged in the conventional techniques. This is the zone where the position of the vehicle should be stabilized by guiding the first diverging roller and the second diverging roller to the first diverging guide and the second diverging guide. Using a preferred embodiment of the present invention, while the no-guide zone has a sufficient length, lengthening of the entirety of the connection rail is avoided. The preferable movement of the vehicle between the first main rail and the second main rail is performed, and the shortening of the connection rail is also achieved.

As described above, according to the rail guided vehicle system of a preferred embodiment of the present invention, the system is made smaller by shortening the connection rail.

The vehicle may include a main body member and a plurality of bogie truck units that are arranged to rotate in a horizontal direction relative to the main body member. The travelling unit, the diverging roller supporting member, and the position stabilizing roller supporting member may be arranged in each of the plurality of bogie truck units.

In this structure, since the plurality of bogie truck units are arranged in the vehicle, the vehicle can be larger. Specifically, when the vehicle reaches a curve of the rail, each of the plurality of bogie truck units rotates along the horizontal direction with a different angle from those of other bogie truck units, thus the preferable travelling of the vehicle is achieved.

The position stabilizing roller may include a first roller member and a second roller member. The first roller member and the second roller member are attached with a gap in between in the width direction of the travelling unit. The position stabilizing roller guide includes a first roller guide member and a second roller guide member. The first roller guide member extends along the extending direction on one side of the connection rail in the width direction of the connection rail and in the no-guide zone. The first roller guide member is configured to guide the first roller member. The second roller guide member extends along the extending direction on another side of the connection rail in the width direction of the connection rail in the no-guide zone. The second roller guide member is configured to guide the second roller member.

In this structure, in the vehicle reaching the no-guide zone from the first diverging guide, the first roller member is first guided by the first roller guide member. Then, after the vehicle moves across the end of the first roller guide member, the second roller member is guided by the second roller guide member. With the first roller member, the second roller member, the first roller guide member, and the second roller guide member, the fluctuations in the right and left directions and the mismatches of the position are prevented. As a result, the position of the vehicle in the no-guide zone is better stabilized.

The rail may be arranged on a ceiling or in the vicinity of the ceiling. The rail includes a first travelling plane portion and a second travelling plane portion at both sides of the lower portion of the rail in the width direction of the rail. The first travelling plane portion and the second travelling plane portion are arranged with a gap in between. The first roller guide member rises in a planar manner from a position closer to the gap of the first travelling plane portion of the connection rail. The second roller guide member rises in a planar manner from a position closer to the gap of the second travelling plane portion of the connection rail. The first roller member and the second roller member are guided by abutting the first roller guide member and the second roller guide member, respectively, from the outer sides of the connection rail in the width direction of the connection rail.

In this structure, each of the first roller member and the second roller member is guided by abutting the first roller guide member and the second roller guide member, respectively. Specifically, the first roller member is guided while the first roller guide member abuts the first roller member from the inner side of the connection rail in the width direction of the connection rail. On the other hand, the second roller member is guided while the second roller guide member abuts the second roller member from the inner side of the connection rail in the width direction of the connection rail. Therefore, the position of the vehicle in the no-guide zone is better stabilized.

The rail, which is arranged on a ceiling or in the vicinity of the ceiling, may include a first travelling plane portion and a second travelling plane portion. The first travelling plane portion and the second travelling plane portion are disposed at both sides of the lower portion of the rail. A gap is defined between the first travelling plane portion and the second travelling plane portion.

The rail further includes a first projecting member and a second projecting member. The first projecting member projects toward the gap from the first travelling plane portion in the no-guide zone. The first projecting member extends a predetermined length along the extending direction of the connection rail. The first projecting member includes a first side plane portion at the end side of the first projecting member in a width direction of the first projecting member. The second projecting member projects toward the gap from the second travelling plane portion such that the second projecting member does not overlap with the first projecting member in the extending direction of the connection rail in the no-guide zone. The second projecting member extends a predetermined length along the extending direction of the connection rail. The second projecting member includes a second side plane portion at the end side of the second projecting member in a width direction of the second projecting member. The position stabilizing roller supporting member is arranged at the lower side of the travelling unit. The position stabilizing roller supporting member supports the position stabilizing rollers such that the position stabilizing rollers abut the first side plane portion and the second side plane portion.

In this structure, the position stabilizing rollers in the no-guide zone first abut the first side plane portion that exists at the one side of the connection rail in the width direction of the connection rail. Then, the position stabilizing rollers abut the second side plane portion that exists at another side of the connection rail in the width direction of the connection rail. The travelling position of the vehicle in the no-guide zone is stabilized. When the position stabilizing rollers abut the first side plane portion, the position can be better stabilized by a side roller abutting the rail wall at another side. When the position stabilizing rollers abut the second side plane portion, the position can also be better stabilized by a side roller abutting the rail wall at one side.

The position stabilizing rollers may be arranged in a line along a travelling direction of the vehicle, in the vicinity of the center portion of the lower side of the travelling unit in the width direction of the travelling unit. The first side plane portion and the second side plane portion are separated from each other by a gap equal or substantially equal to a diameter of the position stabilizing roller in the width direction.

In this structure, since plural portions of the position stabilizing rollers abut the first side plane portion and the second side plane portion, fluctuations in the right and left directions and the mismatches of the position are prevented with a smaller number of the position stabilizing rollers. The travelling position of the vehicle in the no-guide zone is stabilized. The gap between the first side plane portion and the second side plane portion does not have to be exactly equal to the diameter of the position stabilizing roller, as long as the gap and the diameter have almost the same length.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

The preferred embodiments of the present invention will be explained below based on the figures.

First Preferred Embodiment

Figure 1:
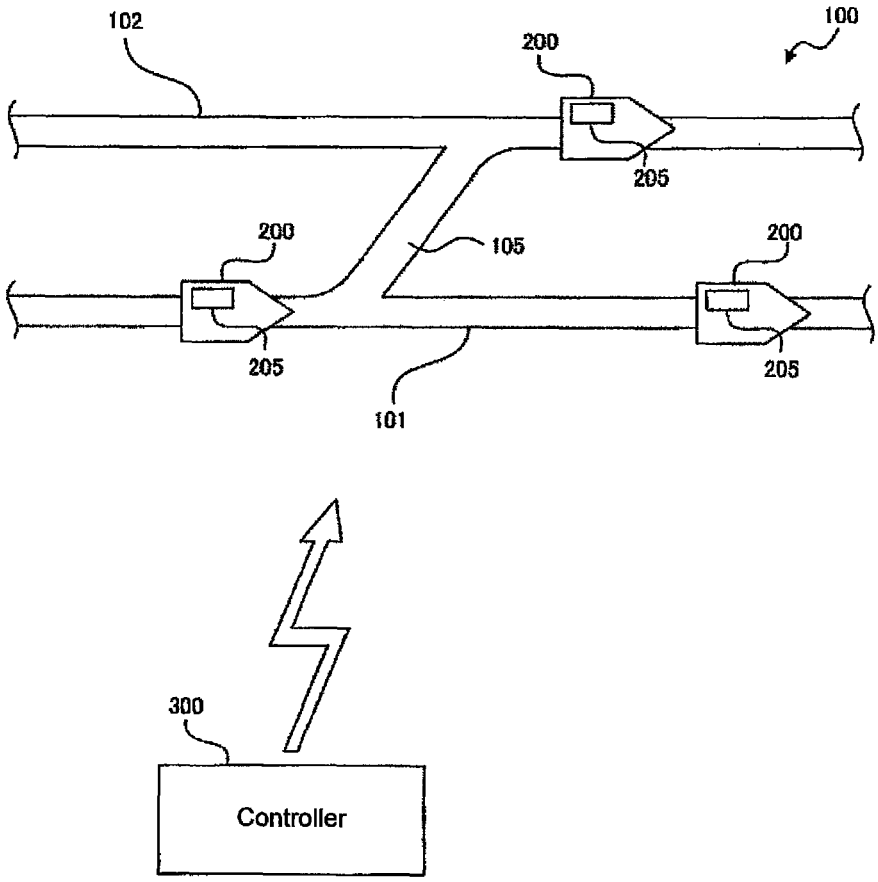
FIG. 1 is a plan view showing the overall structure of the rail guided vehicle system according to a first preferred embodiment of the present invention.

First, the overall structure of the rail guided vehicle system according to the first preferred embodiment of the present invention will be explained, referring to FIG. 1. FIG. 1 is a plan view showing the overall structure of the rail guided vehicle system according to the first preferred embodiment.

In FIG. 1, the rail guided vehicle system according to the present preferred embodiment includes a rail 100, vehicles 200, and a controller 300.

The rail 100 preferably is arranged on a ceiling and made of metal such as aluminum, stainless steel, etc. The rail 100 includes a first main rail 101 and a second main rail 102, and a connection rail 105. The first main rail 101 and the second main rail 102 are arranged parallel or substantially parallel to each other. The connection rail 105 connects the first main rail 101 to the second main rail 102. Thus, the vehicles 200 travelling on the first main rail 101 can move to the second main rail 102 by travelling on the connection rail 105.

A plurality of vehicles 200 are arranged on the rail 100 and can convey FOUPs, as articles to be conveyed, by travelling along the rail 100.

In addition, each of the vehicles 200 includes an on-board controller 205. The on-board controller 205 receives conveying instructions from the controller 300, and controls the travelling of the vehicle 200. It should be noted that the on-board controller 205 not only is programmed to control the travelling of the vehicle 200, but also is programmed to control all of the apparatuses included in the vehicle 200.

The controller 300 includes an arithmetic circuit, a memory, etc. and is configured to give the conveying instructions to the vehicle 200 via the on-board controller 205.

Although not shown in the figure, a shelf (for example, a buffer, a port, etc.) storing the FOUP temporarily and a semiconductor fabricating apparatus are arranged in the location along the rail 100.

Figure 2:
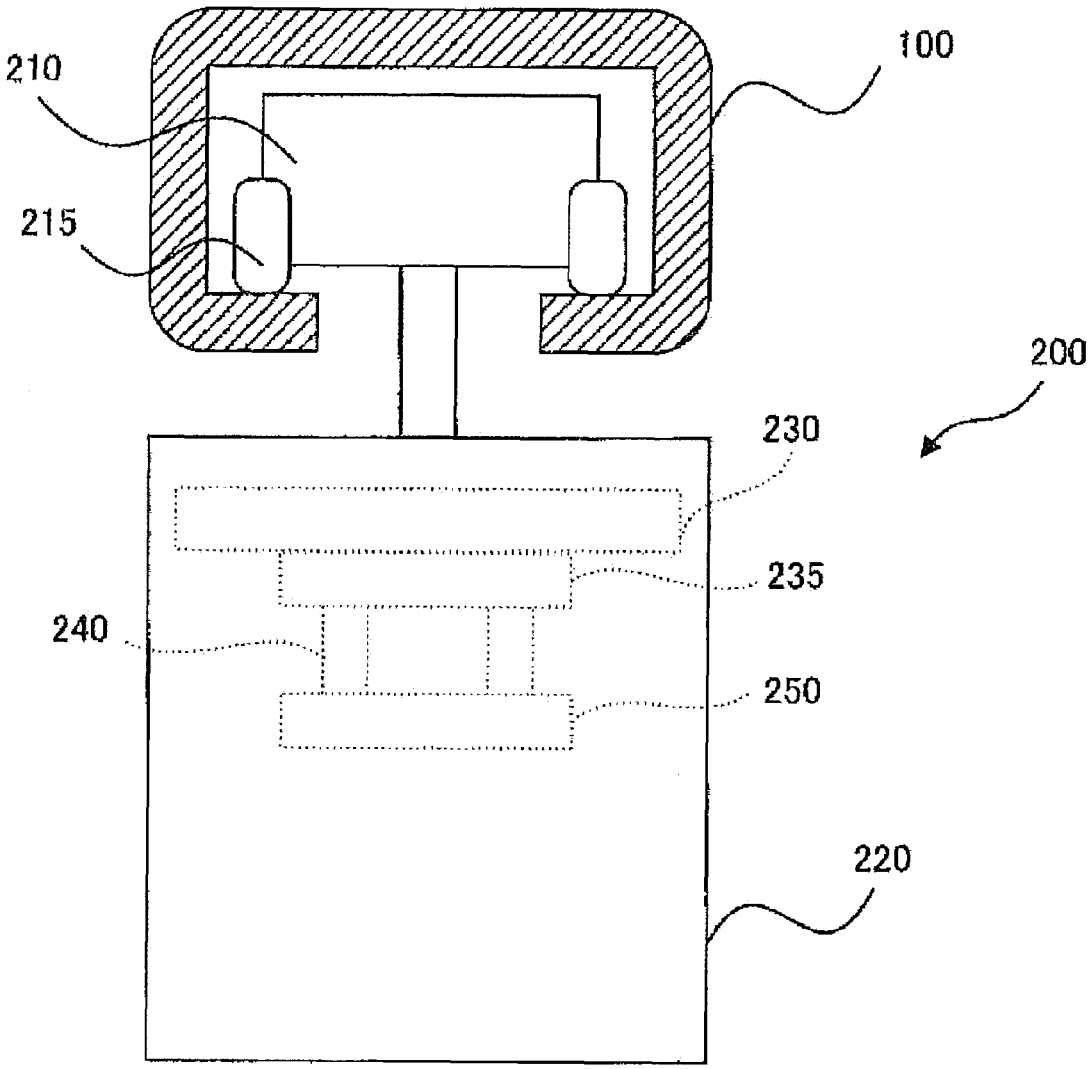
FIG. 2 is a side view showing the structure of the vehicle according to the first preferred embodiment of the present invention.

Next, the further detailed structure of the vehicle 200 will be explained referring to FIG. 2. FIG. 2 is a side view showing the structure of the vehicle according to the first preferred embodiment.

In FIG. 2, the vehicle 200 includes a travelling unit 210, a main body member 220, a moving unit 230, a hoist unit 235, a hoist belt 240, and a gripping unit 250. Diverging rollers and position stabilizing rollers, which are described later, are omitted in FIG. 2 for the convenience of this explanation.

The vehicle 200 travels along the rail 100 while travelling rollers 215 are rolled by a driving power of the travelling unit 210, e.g., a linear motor. The main body member 220 is suspended on the bottom plane of the travelling unit 210.

The moving unit 230 is attached to the main body member 220. The moving unit 230 can move to the side (namely, in the right and left directions in FIG. 2) of the rail 100. The hoist unit 235 is attached to the bottom plane of the moving unit 230.

The gripping unit 250 that grips the FOUP is attached to the bottom plane of the hoist unit 235 by the hoist belt 240. The gripping unit 250 can ascend or descend relative to the main body member 220 by winding off or reeling in the hoist belt 240.

Figure 3:
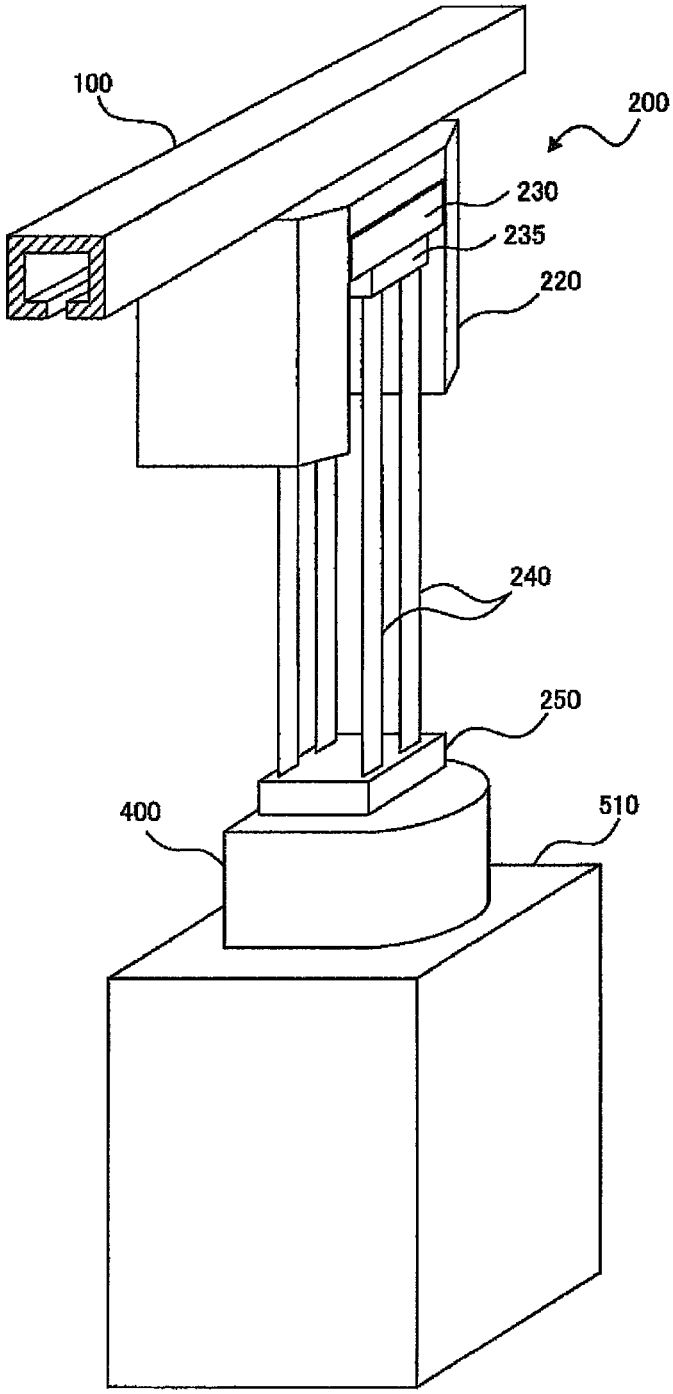
FIG. 3 is a perspective view showing the transferring operation of the vehicle according to the first preferred embodiment of the present invention.
Figure 4:
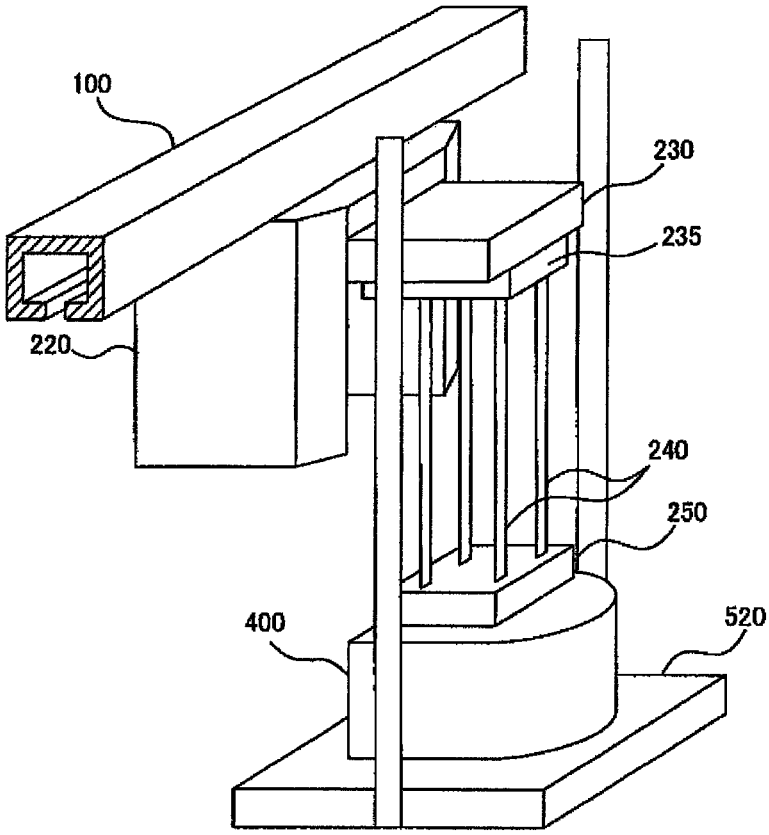
FIG. 4 is a perspective view showing the lateral transferring operation of the vehicle according to the first preferred embodiment of the present invention.

Next, the method of transferring the FOUP by the vehicle will be explained referring to FIGS. 3 and 4. FIGS. 3 and 4 are perspective views showing the method of transferring the FOUP by the vehicle according to the first preferred embodiment.

In FIG. 3, when the vehicle 200 transfers the FOUP 400 on the port 510 located right below the rail 100, the vehicle 200 first travels on the rail 100 and stops over the FOUP 400 arranged on the port 510.

Next, as shown in FIG. 3, the hoist unit 235 winds off the hoist belt 240 and the gripping unit 250 then descends to the location of the FOUP 400. The gripping unit 250 then grips the FOUP 400.

After the gripping unit 250 grips the FOUP 400, the hoist unit 235 reels the hoist belt 240 so that the gripping unit 250 and the FOUP 400 ascend to the location of the main body member 220. Then, the vehicle 200 travels again on the rail 100 and the FOUP 400 is conveyed.

The example shown in FIG. 4 shows the case when the FOUP 400 is arranged at a side buffer 520 located off the side of the rail 100. In this case, after the moving unit 230 moves to the side of the rail 100, the hoist unit 235 winds off the hoist belt 240 and the gripping unit 250 descends to the location of the FOUP 400. With such an operation, it is possible to perform a lateral transfer of the FOUP 400 located off the side of the rail 100.

Figure 5:
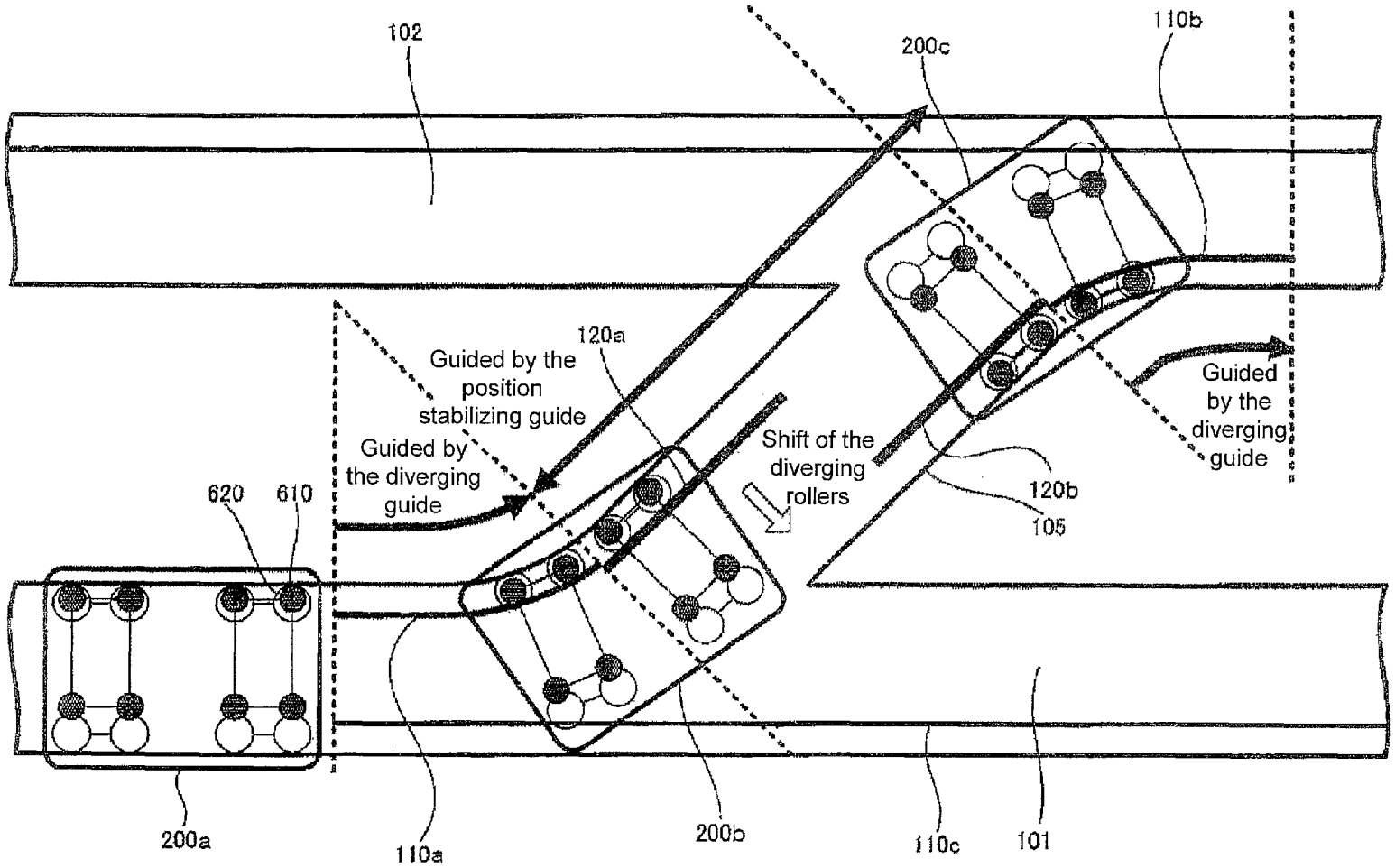
FIG. 5 is a plan view showing travelling of the vehicle according to the first preferred embodiment of the present invention on the connection rail.

Next, an example of a method of travelling on the connection rail by the vehicle according to the present preferred embodiment, and the specific structures of the vehicle and the rail that realize preferable travelling on the connection rail, will be explained referring to FIGS. 5 through 9. FIG. 5 is a plan view showing the travelling of the vehicle according to the first preferred embodiment on the connection rail. In addition, FIGS. 6 through 9 are cross-sectional views showing the structure of the travelling unit according to the first preferred embodiment together with the rail. FIGS. 6 through 9 show the vehicle viewed from the back side of the vehicle in the travelling direction.

The operation performed when the vehicle 200 travels from the first main rail 101 to the connection rail 105 and then moves to the second main rail 102 will be explained below, referring to FIG. 5. In the vehicle 200 according to the present preferred embodiment, diverging rollers 610 and position stabilizing rollers 620 are arranged in each of the bogie truck units.

Figure 6:
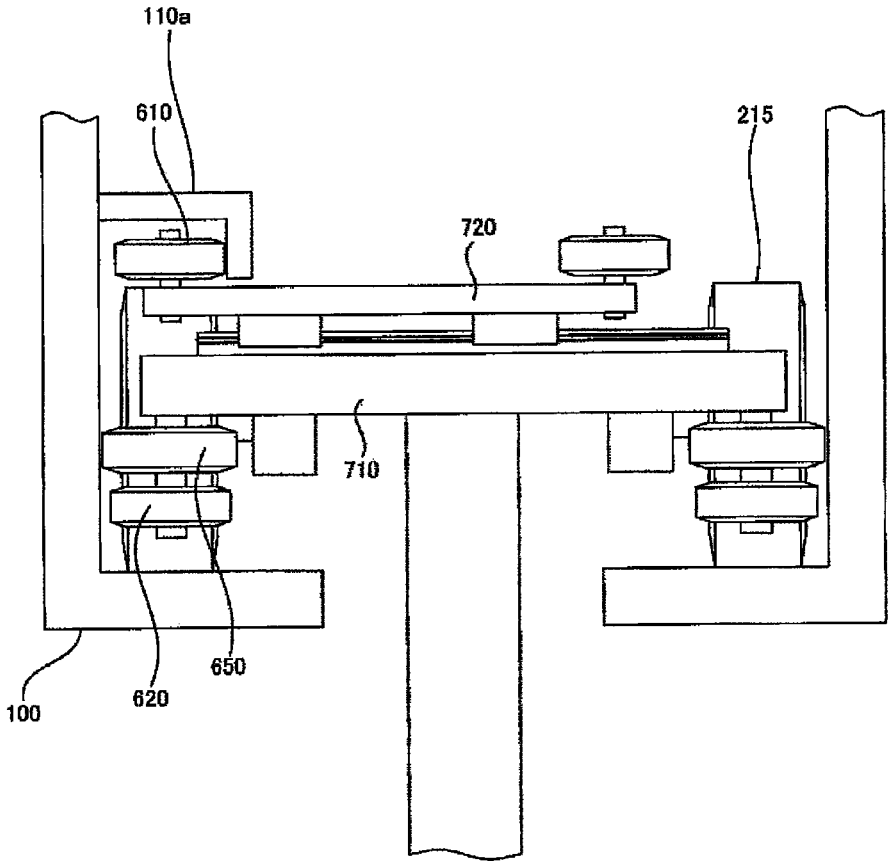
FIG. 6 is a cross-sectional view showing the structure of the travelling unit according to the first preferred embodiment of the present invention together with the rail.

As shown in FIG. 5 and FIG. 6, when the vehicle 200*a* travelling on the first main rail 101 reaches the point where a diverging guide 110*a* is arranged, the diverging rollers 610 are guided by the diverging guide 110*a*. A pair of the diverging rollers 610 are supported by a diverging roller supporting member 720 that is configured to shift in the direction crossing the travelling direction of the vehicle 200 (namely, the right and left directions in FIG. 6). Here, the vehicle 200*a* is about to move to the connection rail 105. The connection rail 105 is located to the left side of the first main rail 101 in the travelling direction. The diverging roller supporting member 720 is shifted to the left side at the point where the diverging guide 110*a* is arranged. In such a situation, the left side one of the pair of the diverging rollers 610 is positioned to be guided by the diverging guide 110*a*. In this manner, the vehicle 200 is guided from the first main rail 101 to the connection rail 105.

On the other hand, when the vehicle 200 is not guided to the connection rail 105, the diverging roller supporting member 720 is shifted to the right side. In such a situation, the diverging rollers 610 are not guided by the diverging guide 110*a* at the side of the connection rail 105 but by a diverging guide 110*c* at the side for travelling straight. Thus, the vehicle 200 is kept travelling on the first main rail 101.

Figure 7:
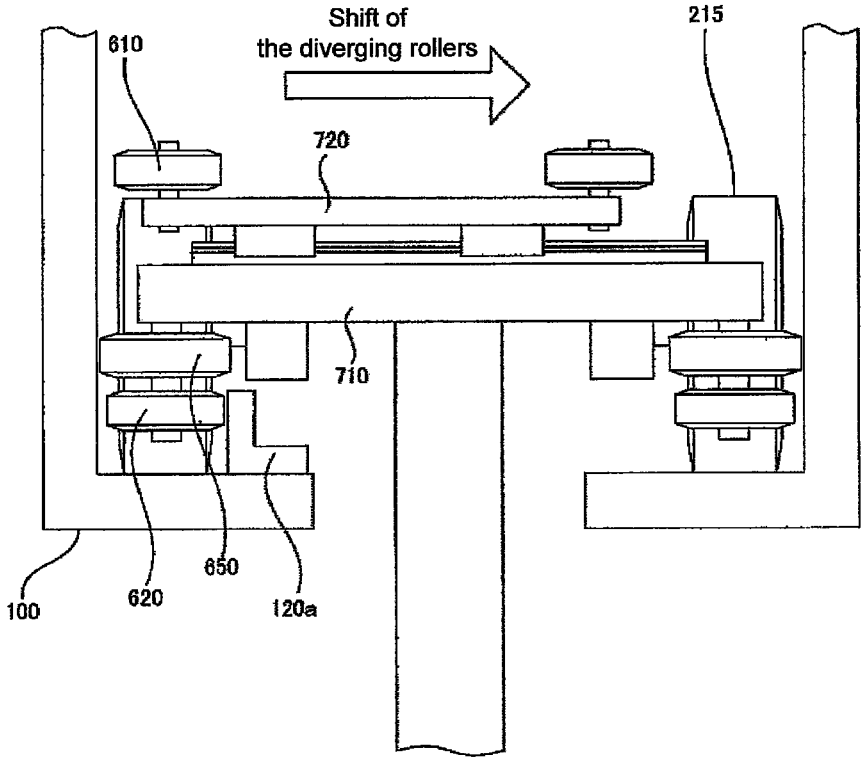
FIG. 7 is a cross-sectional view showing the structure of the travelling unit according to the first preferred embodiment of the present invention together with the rail (Part 2).

As shown in FIG. 5 and FIG. 7, in the vehicle 200*b* having moved to the connection rail 105 and reaching the point where a position stabilizing roller guide 120*a* is arranged, the position stabilizing rollers 620 at the left side are guided by the position stabilizing roller guide 120*a*. A pair of the position stabilizing rollers 620 are supported by the position stabilizing roller supporting member 710, together with a pair of side rollers 650. The position stabilizing rollers 620 are guided by the position stabilizing roller guide 120*a* and are configured to stabilize the position of the vehicle 200.

Figure 8:
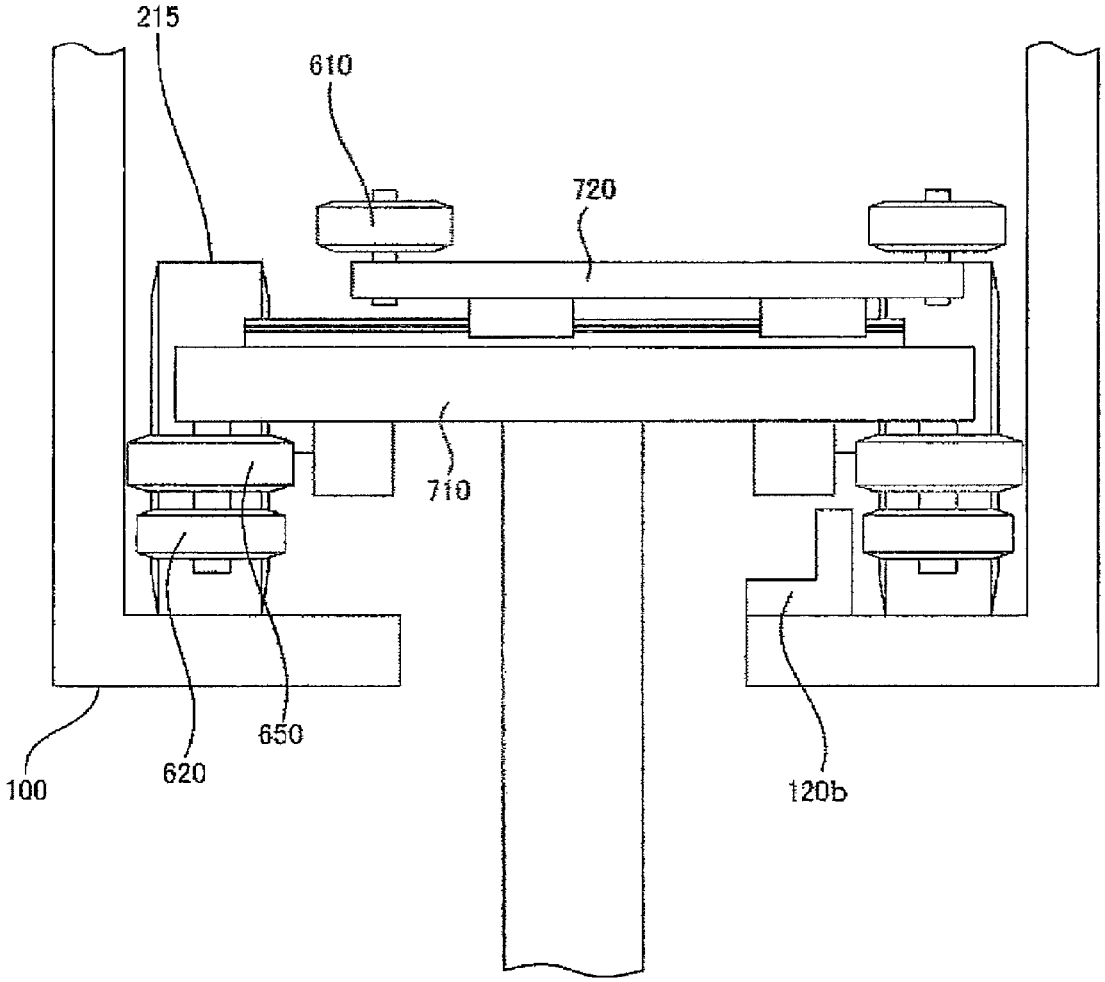
FIG. 8 is a cross-sectional view showing the structure of the travelling unit according to the first preferred embodiment of the present invention together with the rail (Part 3).

As shown in FIG. 5 and FIG. 8, when the vehicle 200*b* reaches the point where the position stabilizing roller guide 120*b* is arranged, the position stabilizing rollers 620 at the right side (namely, the rollers at the side opposite to the side where the rollers that were guided before are arranged) are guided by the position stabilizing roller guide 120*b*. Although the position stabilizing roller guides 120*a* and 120*b* do not overlap with each other in the present preferred embodiment, a zone where both the position stabilizing roller guides 120*a* and 120*b* are overlapping may exist.

In the zone where the position stabilizing rollers 620 are guided by each of the position stabilizing roller guides 120*a* and 120*b*, the diverging roller supporting member 720 is released (namely, the diverging roller supporting member 720 is in the state in which the diverging roller supporting member 720 can be shifted). This is because the diverging guide 110 configured to guide the diverging rollers 610 is not arranged. Therefore, the diverging roller supporting member 720 is shifted to the right side in the zone where the position stabilizing rollers 620 are guided.

Figure 9:
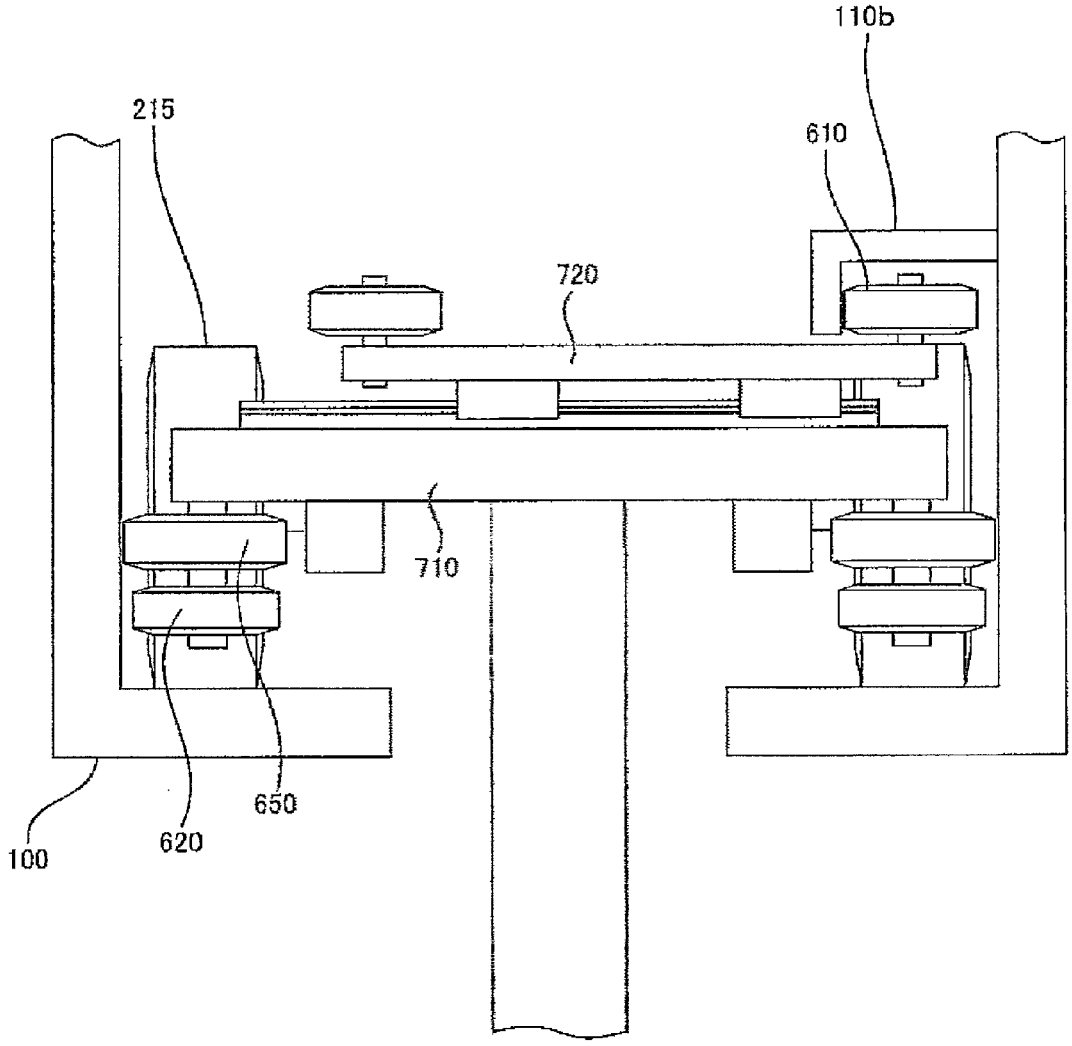
FIG. 9 is a cross-sectional view showing the structure of the travelling unit according to the first preferred embodiment of the present invention together with the rail (Part 4).

As shown in FIG. 5 and FIG. 9, when the vehicle 200*c* reaches the point where the diverging guide 110*b* exists after passing through the zone where the position stabilizing roller guide 120*b* exists, the diverging roller supporting member 720 is shifted to the right side. As a result, the diverging rollers 610 at the right side are guided by the diverging guide 110*b*. Therefore, the vehicle 200 can move from the connection rail 105 to the second main rail 102.

The movement of the vehicle from the first main rail 101 to the second main rail 102 can be preferably realized with the rail guided vehicle system according to the present preferred embodiment, since the diverging rollers 610 and the position stabilizing rollers 620 are respectively guided by the diverging guide 110 and the position stabilizing roller guide 120. In the present preferred embodiment, the position stabilizing rollers 620 are guided by the position stabilizing roller guide 120 in the no-guide zone, the no-guide zone being where the diverging guide 110 is not arranged. Therefore, the position of the vehicle 200 is stabilized even in the no-guide zone.

Figure 10:
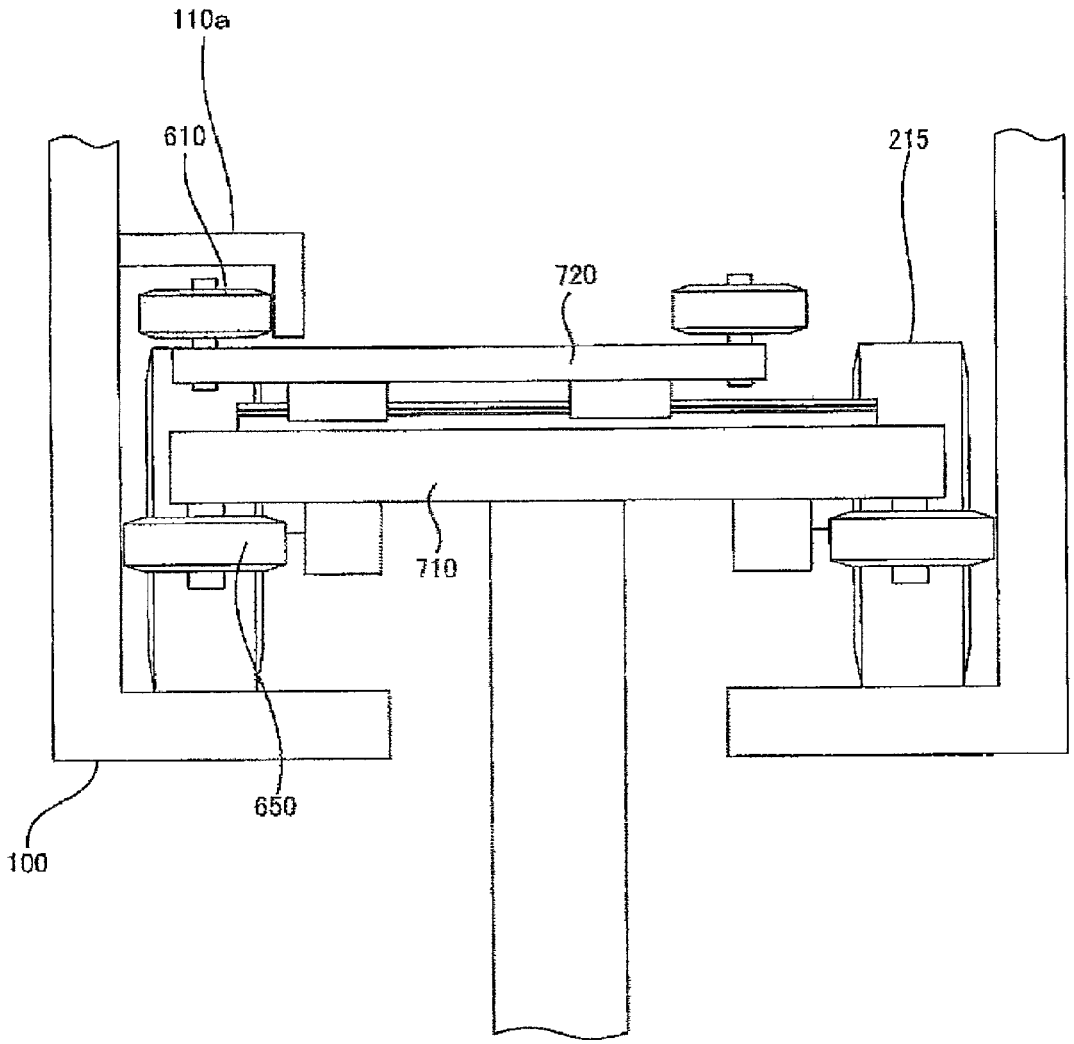
FIG. 10 is a cross-sectional view showing the structure of the travelling unit of the vehicle according to the comparative example, together with the rail.
Figure 11:
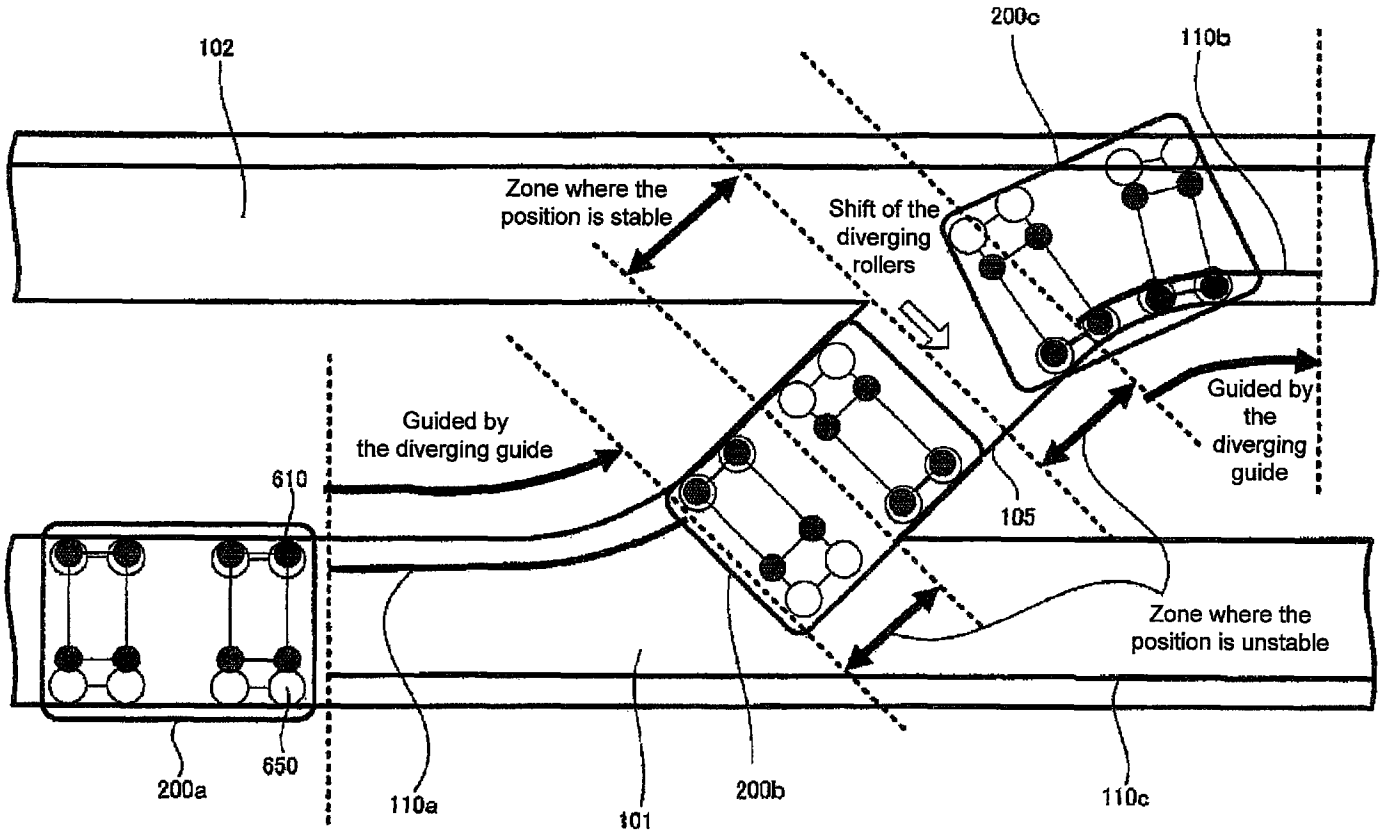
FIG. 11 is a plan view showing the zone where the position of the vehicle according to the comparative example is stable and the zone where the position of the vehicle is unstable.
Figure 12:
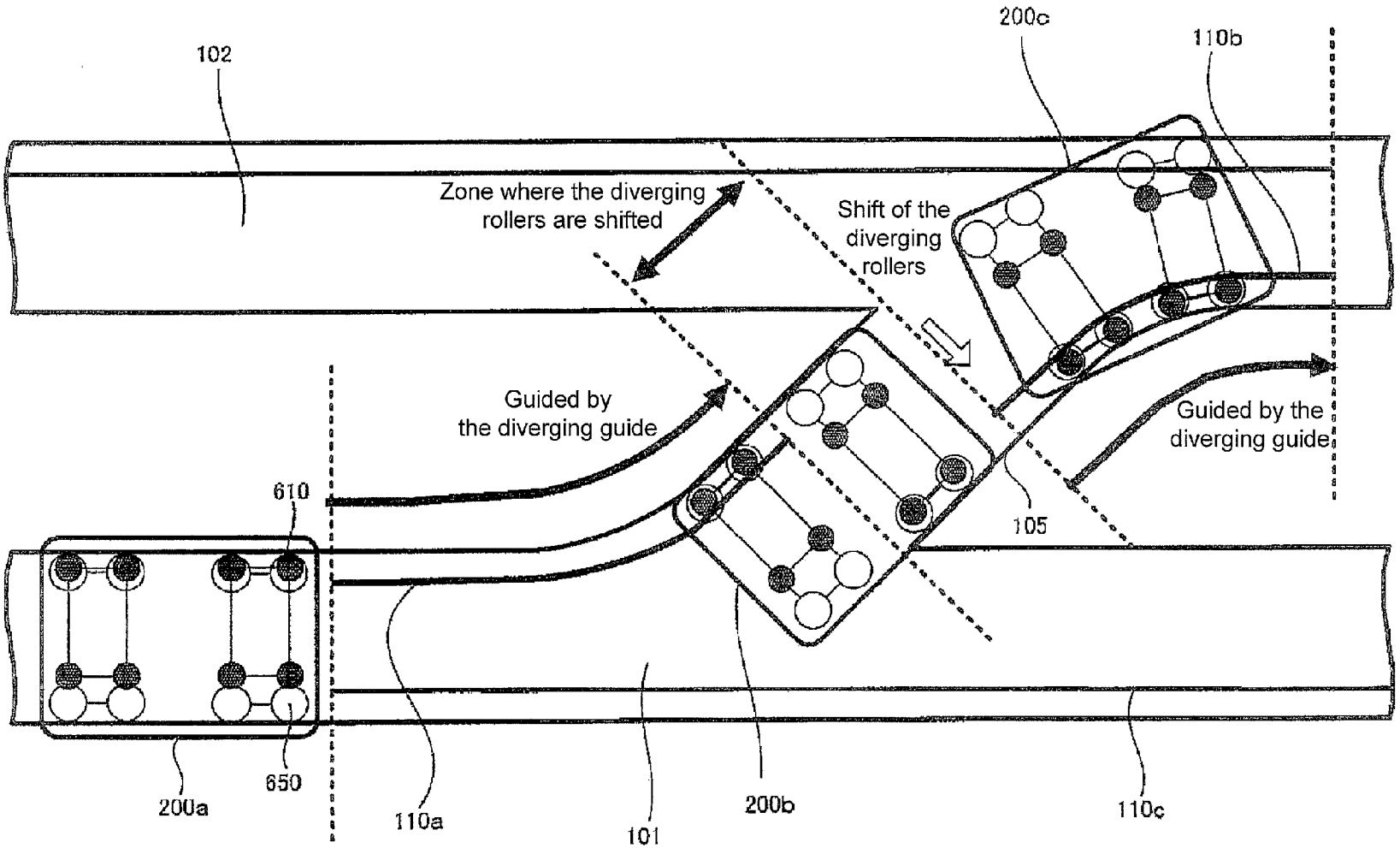
FIG. 12 is a plan view showing a diverging roller shifting zone for the vehicle according to the comparative example.

The rail guided vehicle system that does not include the above-described position stabilizing rollers 620 and the position stabilizing roller guide 120 will be explained, referring to FIGS. 10 through 12. FIG. 10 is a cross-sectional view showing the structure of the travelling unit of the vehicle together with the rail, according to the comparative example. FIG. 11 is a plan view showing the zone where the position of the vehicle according to the comparative example is stable, and the zone where the position of the vehicle is unstable. FIG. 12 is a plan view showing a diverging roller shifting zone for the vehicle according to the comparative example.

As shown in FIG. 10 and FIG. 11, in the rail guided vehicle system according to the comparative example, the position stabilizing rollers 620 and the position stabilizing roller guide 120 are absent. Thus, in the zone where both side rollers 650 located at the right and left sides abut rail walls (namely, the inner side plane of the rail 100) in the no-guide zone where the diverging guide 110 is absent, the position of the vehicle 200 is stable. However, as shown in FIG. 11, in the no-guide zone where the diverging guide 110 is absent, there is a zone where the rail wall exists only at one side in the travelling direction. In this zone, the side rollers 650 abut only one of the rail walls. Thus, in the above-described zone, since the position cannot be stabilized by the side rollers 650, it is hard to stabilize the position of the vehicle 200. Therefore, in order to realize the stable travelling of the vehicle 200 in the connection rail 105, it is required to lengthen the diverging guide 110.

As shown in FIG. 12, if the diverging guide 110 is lengthened in the rail guided vehicle system according to the comparative example, the length of the zone where the diverging rollers 610 are shifted (namely, the no-guide zone where the diverging guide 110 is not arranged) becomes shorter. Therefore, there might be the case in which it is hard for the diverging rollers 610 to be shifted properly. In addition, in such a case, the use of a forcing guide, configured to force the diverging rollers 610 to be shifted, is possible. However, even if the forcing guide is used, the diverging rollers 610 need to be shifted rapidly unless the vehicle 200 is slowed down. Shifting the diverging rollers 610 rapidly might cause abnormal operations because the diverging rollers 610 might receive a large force. In addition, since, if the diverging rollers 610 are rapidly shifted, the impulsion generated when the diverging rollers 610 abut the diverging guide 110 becomes large, the vibration of the vehicle 200 and/or the damages of the diverging rollers 610 might occur.

On the other hand, the rail guided vehicle system according to the present preferred embodiment shown in FIGS. 5 through 9 includes the position stabilizing rollers 620 and the position stabilizing roller guide 120. As a result, the no-guide zone, where the diverging guide 110 is not arranged, is lengthened. Thus, the shifting operation of the diverging rollers 610 is reliably and safely performed.

As it can be seen by comparing FIG. 5 with FIG. 11 and FIG. 12, in the rail guided vehicle system according to the present preferred embodiment, while the no-guide zone is longer than that of the rail guided vehicle system according to the comparative example, the lengths of the connection rail 105 are same. More specifically, the rail guided vehicle system according to the present preferred embodiment prevents the connection rail 105 from becoming longer even if the no-guide zone is lengthened. Thus, the connection rail 105 can be shortened even if the no-guide zone is lengthened.

As explained above, with the rail guided vehicle system according to the present preferred embodiment, the position stabilizing rollers 620 makes possible the stable travelling on the connection rail. In addition, the position stabilizing rollers 620 make the system smaller by shortening the length of the connection rail 105.

Second Preferred Embodiment

Next, the rail guided vehicle system according to the second preferred embodiment of the present invention will be explained. Only some of the structures in the second preferred embodiment are different from those of the above-described first preferred embodiment and other structures of the second preferred embodiment are almost the same as those of the first preferred embodiment. Therefore, only the structures that are different from those of the first preferred embodiment will be explained below, and the explanation of structures that are the same as those of the first preferred embodiment will be omitted from the following description accordingly.

Figure 13:
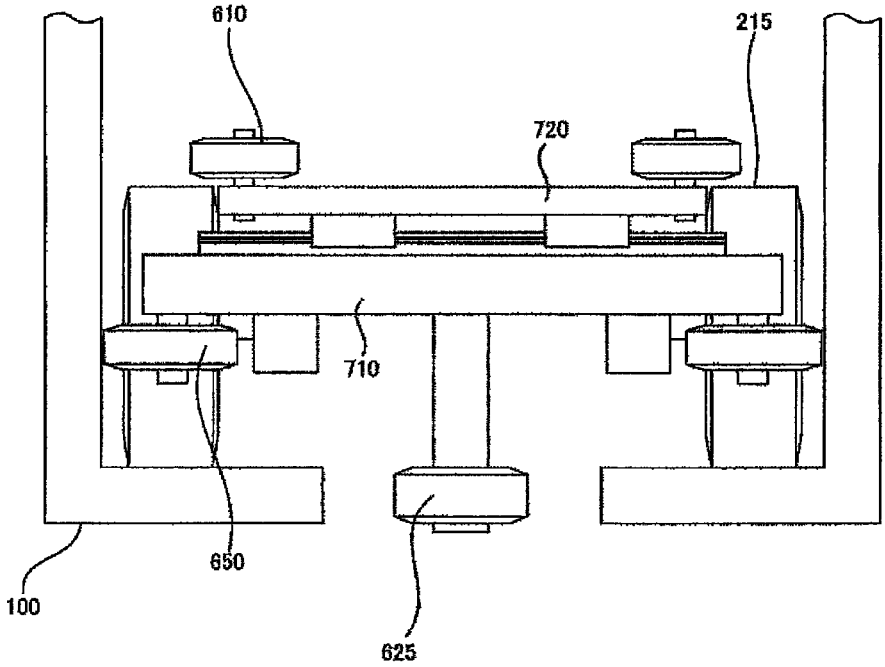
FIG. 13 is a cross-sectional view showing the structure of the travelling unit of the vehicle according to a second preferred embodiment of the present invention together with the rail.
Figure 14:
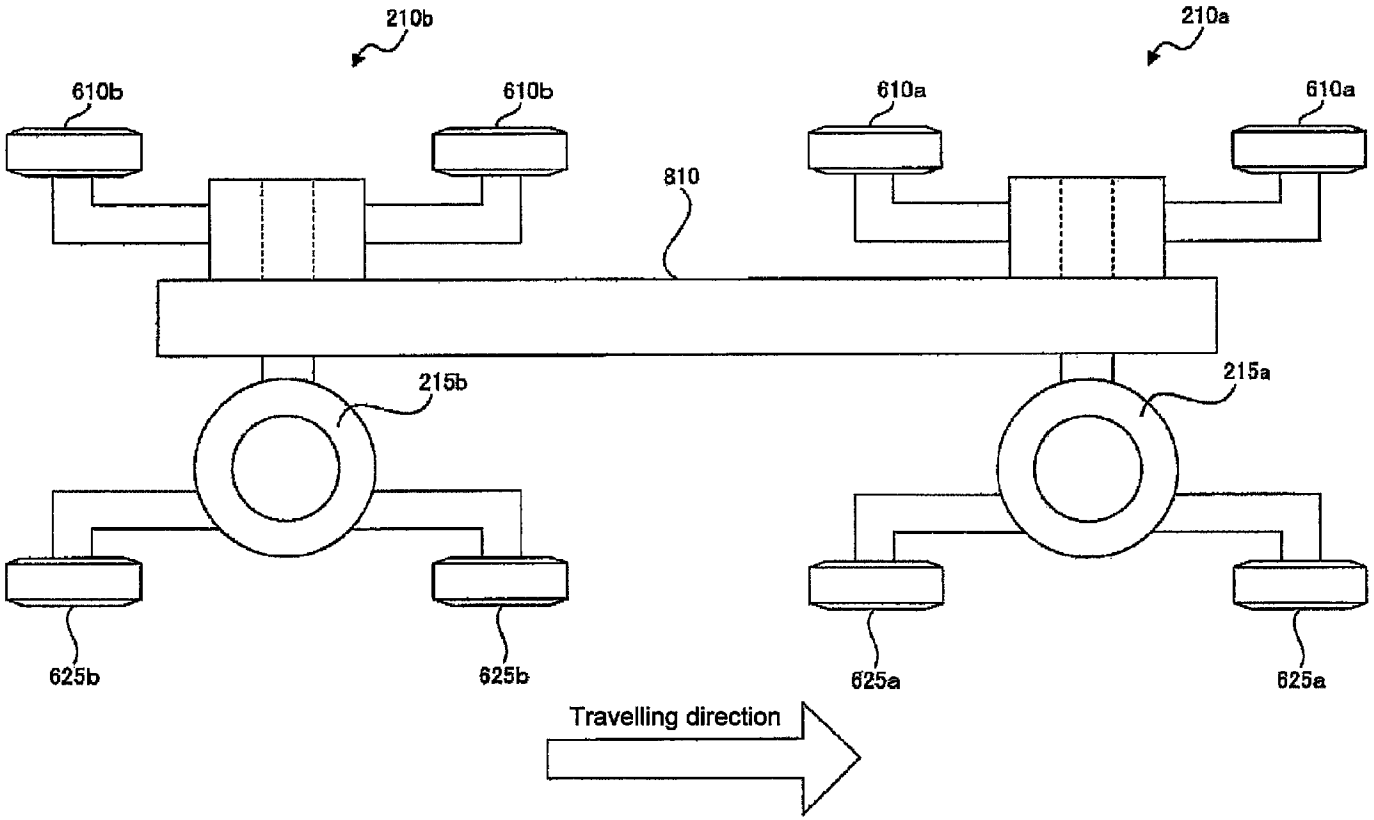
FIG. 14 is a side view showing the structure of the travelling unit of the vehicle according to the second preferred embodiment of the present invention.

The structure of the vehicle according to the second preferred embodiment will be explained, referring to FIG. 13 and FIG. 14. FIG. 13 is a cross-sectional view showing the structure of the travelling unit of the vehicle according to the second preferred embodiment together with the rail. FIG. 14 is a side view showing the structure of the travelling unit of the vehicle according to the second preferred embodiment.

As shown in FIG. 13, in the vehicle 200 according to the second preferred embodiment, lower position stabilizing rollers 625 are arranged at the lower portion of the travelling unit 210. The lower position stabilizing rollers 625 are fixed so as not to be shifted, and are arranged at the position closer to the lower plane of the rail 100 (namely, the travelling plane on which the travelling unit 210 travels).

As shown in FIG. 14, the lower position stabilizing rollers 625 are arranged in a line along the travelling direction of the vehicle 200. Specifically, two lower position stabilizing rollers 625*a* are arranged longitudinally at the front side of the travelling unit 210*a* in the travelling direction. In addition, two lower position stabilizing rollers 625*b* are arranged longitudinally at the back side of the travelling unit 210*b* in the travelling direction.

Figure 15:
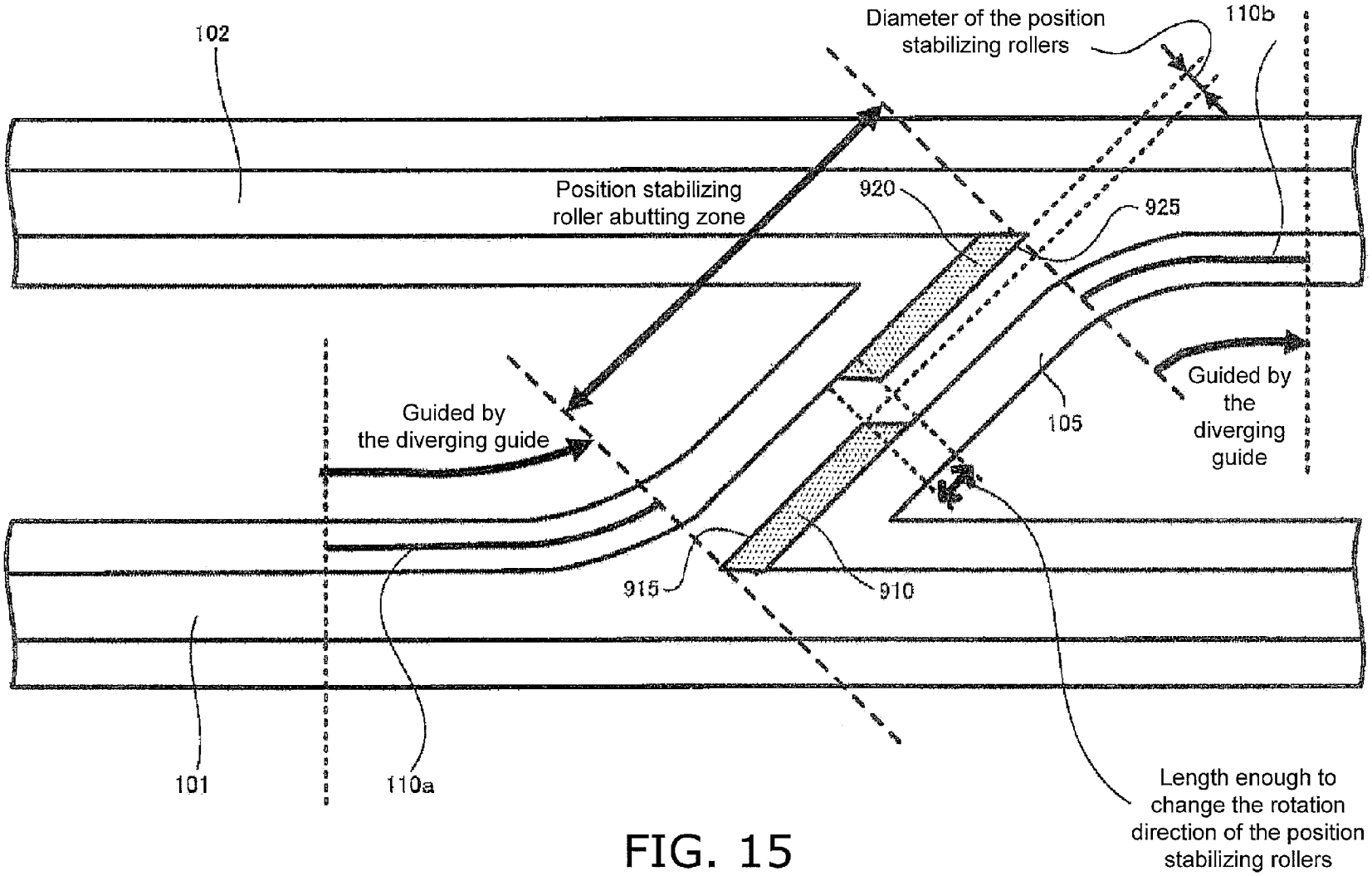
FIG. 15 is a plan view showing the structure of the travelling plane of the rail according to the second preferred embodiment of the present invention.

Next, the structure of the rail in the rail guided vehicle system according to the second preferred embodiment will be explained, referring to FIG. 15. FIG. 15 is a plan view showing the structure of the travelling plane of the rail according to the second preferred embodiment.

As shown in FIG. 15, the rail 100 according to the second preferred embodiment includes a first projecting member 910 and a second projecting member 920 in the travelling plane of the connection rail 105. The first projecting member 910 includes a first side plane portion 915. The second projecting member 920 includes a second side plane portion 925. As described later, the first side plane portion 915 and the second side plane portion 925 are arranged at the position where they abut the lower position stabilizing rollers 625.

The first projecting member 910 is arranged at the right side of the rail 100 in the travelling direction and extends from the vicinity of the diverging point of the first main rail 101 and the connection rail 105, to the middle of the connection rail 105. The second projecting member 920 is arranged to the left side of the rail 100 in the travelling direction and extends from the middle of the connection rail 105 to the vicinity of the merging point of the connection rail 105 and the second main rail 102. The first projecting member 910 and the second projecting member 920 are arranged at the position where they do not overlap with each other in the travelling direction of the vehicle 200.

The length of the gap between the first side plane portion 915 and the second side plane portion 925 in the travelling direction of the vehicle 200 is long enough to change the rotation direction of the lower position stabilizing roller 625. In addition, the length of the gap between the first side plane portion 915 and the second side plane portion 925 in the direction crossing the travelling direction of the vehicle 200 is equal to the diameter of the lower position stabilizing roller 625.

Figure 16:
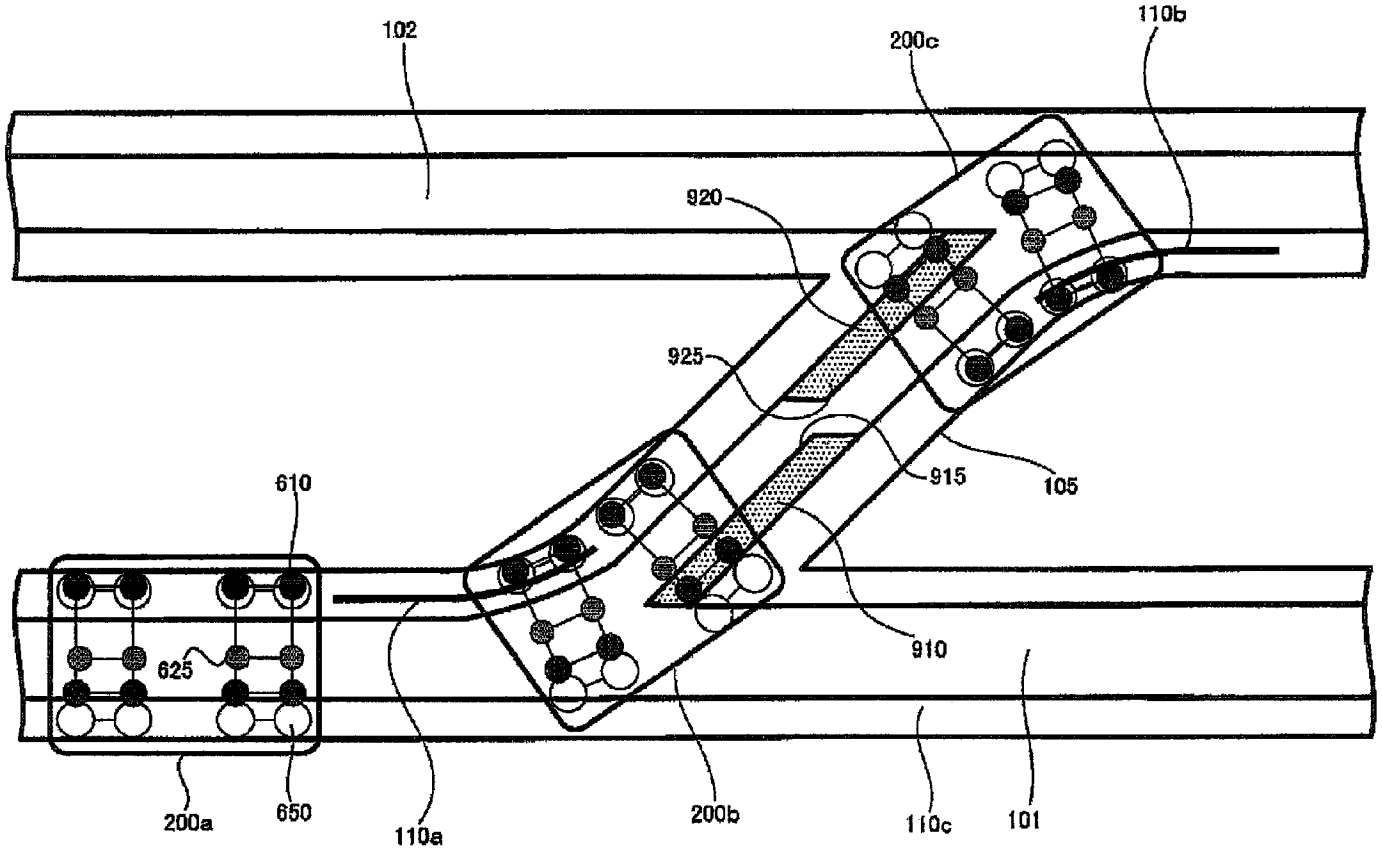
FIG. 16 is a plan view showing the travelling of the vehicle according to the second preferred embodiment of the present invention on the connection rail.
Figure 17:
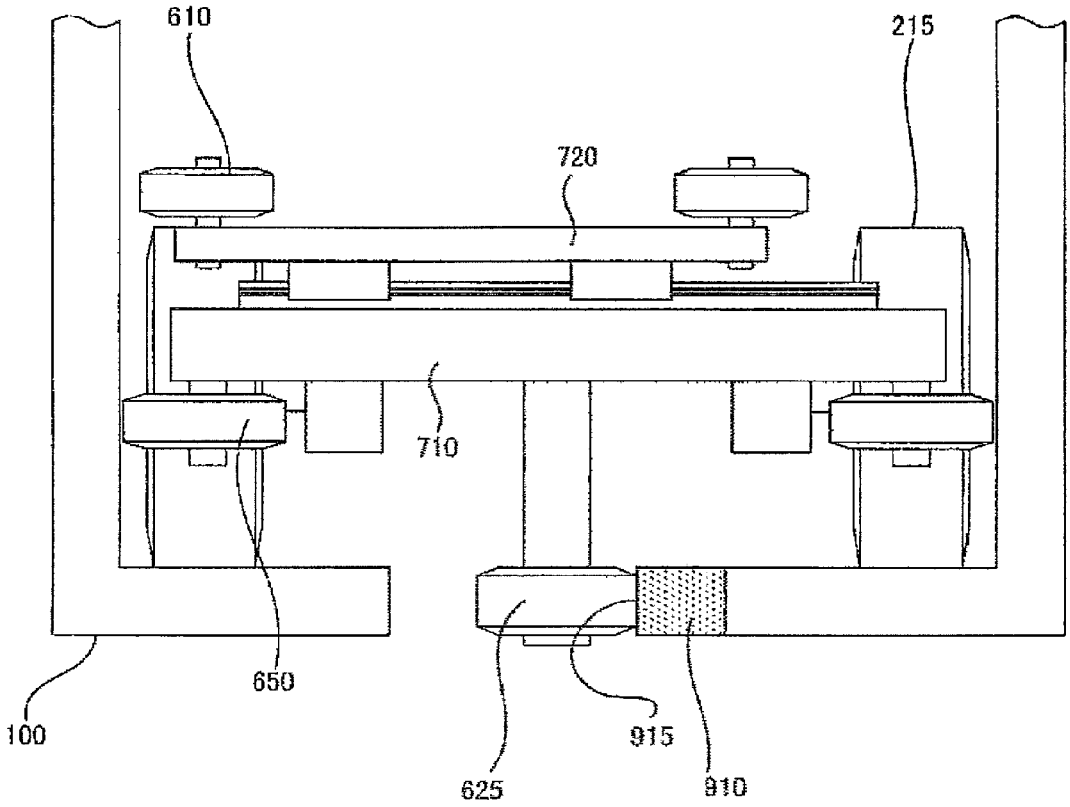
FIG. 17 is a cross-sectional view showing the structure of the travelling unit of the vehicle according to the second preferred embodiment of the present invention together with the rail.
Figure 18:
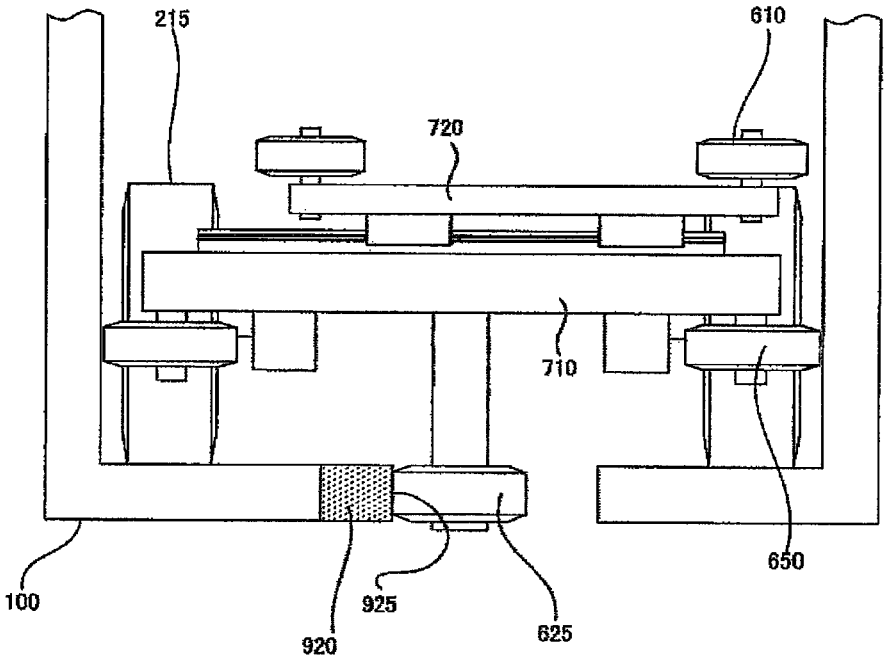
FIG. 18 is a cross-sectional view showing the structure of the travelling unit of the vehicle according to the second preferred embodiment of the present invention together with the rail (Part 2).

Next, the method of travelling on the connection rail 105 by the vehicle 200 according to the second preferred embodiment and the operation of the travelling unit 210 will be explained in detail, referring to FIGS. 16 through 18. FIG. 16 is a plan view showing the travelling of the vehicle according to the second preferred embodiment on the connection rail. FIG. 17 and FIG. 18 are cross-sectional views showing the structure of the travelling unit of the vehicle according to the second preferred embodiment together with the rail.

The operation that is performed when the vehicle 200*a* travels from the first main rail 101 to the connection rail 105 and then moves to the second main rail 102 will be explained below. Since the guiding operation and the shifting operation of the diverging rollers 610 are the same as those in the above-described first preferred embodiment, here the operation of the lower position stabilizing rollers 625 that is unique in the second preferred embodiment will be explained in detail.

As shown in FIG. 16 and FIG. 17, in the vehicle 200*b* reaching the connection rail 105, the lower position stabilizing rollers 625 abut the first side plane portion 915 of the first projecting member 910 when the vehicle 200*b* moves across the end of the diverging guide 110*a*. Thus, the position of the vehicle 200 can be stabilized even if the diverging rollers 610 are not guided by the diverging guide 110*a*. Specifically, the position of the vehicle 200 is maintained by the abutting portion of the lower position stabilizing rollers 625 and the first side plane portion 915, and by the abutting portion of the side rollers 650 at the left side and the rail wall.

As shown in FIG. 16 and FIG. 18, when the vehicle 200*b* moves across the end of the first projecting member 910, the lower position stabilizing rollers 625 then abut the second side plane portion 925 of the second projecting member 920. Thus, the position of the vehicle 200 can be stabilized even if the diverging rollers 610 are not guided by the diverging guide 110*b* existing at the side of the second main rail 102. Specifically, the position of the vehicle 200 is maintained by the abutting portion of the lower position stabilizing rollers 625 and the second side plane portion 925, and by the abutting portion of the side rollers 650 at the right side and the rail wall.

As shown in FIG. 16, when the vehicle 200 reaches the second main rail 102 and moves across the end of the second projecting member 920, the diverging rollers 610 are guided by the diverging guide 110*b*. Therefore, the position of the vehicle 200 is stabilized even if the lower position stabilizing rollers 625 do not abut the second side plane portion 925.

As described above, with the lower position stabilizing rollers 625, and the first projecting member 910 and the second projecting member 920, the travelling position of the vehicle 200 is stabilized even in the zone where the diverging guide 110 does not exist. Therefore, the zone where the diverging guide 110 is arranged can be shortened. By shortening the zone where the diverging guide 110 is arranged, the no-guide zone can be lengthened without changing the length of the connection rail 105. More specifically, even if the no-guide zone is lengthened, the connection rail 105 does not become longer due to the lengthening of the no-guide zone. As a result, the connection rail 105 can be shortened.

As described above, with the rail guided system according to the second preferred embodiment, like the above-described first preferred embodiment, the lower position stabilizing rollers 625 enable the travelling on the connection rail 105 to be stable and the system is made smaller by shortening the length of the connection rail 105.

The present invention is not limited to the above-described preferred embodiments and can be changed without departing from the scope or concept of the present invention that can be read from the claims and the entire specification. The rail guided vehicle system including such changes is also within the scope of the present invention.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A rail guided vehicle system comprising:

a rail that includes a first main rail, a second main rail, and a connection rail that connects the first main rail to the second main rail; and vehicles that travel while being supported and guided by the rail;

each of the vehicles including:

a travelling unit configured to travel on the rail;

a first diverging roller and a second diverging roller that are arranged with a gap in between the first diverging roller and the second diverging roller in a width direction of the travelling unit;

a diverging roller supporting member arranged in the travelling unit, the diverging roller supporting member supporting the first diverging roller and the second diverging roller such that the first diverging roller and the second diverging roller shift in the width direction of the travelling unit;

position stabilizing rollers configured to stabilize a travelling position of the travelling unit; and a position stabilizing roller supporting member that is arranged in the travelling unit, the position stabilizing roller supporting member supporting the position stabilizing rollers such that the position stabilizing rollers do not shift in the width direction of the travelling unit; and the rail includes:

a first diverging guide that extends, on one side of the connection rail in a width direction of the connection rail, from the first main rail along an extending direction of the connection rail, the first diverging guide being configured to guide the first diverging roller;

a second diverging guide that extends, on another side of the connection rail in the width direction of the connection rail, to the second main rail along the extending direction of the connection rail while having a no-guide zone that does not overlap with the first diverging guide in the extending direction of the connection rail, the second diverging guide being configured to guide the second diverging roller; and a position stabilizing roller guide that is arranged in the no-guide zone, the position stabilizing roller guide being configured to guide the position stabilizing rollers in the no-guide zone.

2. The rail guided vehicle system according to claim 1, wherein each of the vehicles includes a main body member and a plurality of bogie truck units that are arranged so as to rotate in a horizontal direction of the main body member; and the travelling unit, the diverging roller supporting member, and the position stabilizing roller supporting member are arranged in each of the plurality of bogie truck units.

3. The rail guided vehicle system according to claim 1, wherein the position stabilizing roller includes a first roller member and a second roller member, the first roller member and the second roller member being attached with a gap in between in the width direction of the travelling unit; and the position stabilizing roller guide includes:

a first roller guide member extending along the extending direction on one side of the connection rail in the width direction of the connection rail and in the no-guide zone, the first roller guide member being configured to guide the first roller member; and a second roller guide member extending along the extending direction on another side of the connection rail in the width direction of the connection rail and in the no-guide zone, the second roller guide member being configured to guide the second roller member.

4. The rail guided vehicle system according to claim 3, wherein the rail is arranged on a ceiling or in the vicinity of the ceiling;

the rail includes a first travelling plane portion and a second travelling plane portion at both sides of a lower portion of the rail in the width direction of the rail, the first travelling plane portion and the second travelling plane portion being arranged with a gap in between;

the first roller guide member rises in a planar manner from a position closer to the gap of the first travelling plane portion of the connection rail;

the second roller guide member rises in a planar manner from a position closer to the gap of the second travelling plane portion of the connection rail; and the first roller member and the second roller member are guided by abutting the first roller guide member and the second roller guide member, respectively, from outer sides of the connection rail in the width direction of the connection rail.

5. The rail guided vehicle system according to claim 1, wherein the rail is arranged on a ceiling or in the vicinity of the ceiling;

the rail includes a first travelling plane portion and a second travelling plane portion at both sides of a lower portion of the rail, the rail including a gap between the first travelling plane portion and the second travelling plane portion;

the rail further includes:

a first projecting member that projects toward the gap from the first travelling plane portion in the no-guide zone, the first projecting member extending a predetermined length along the extending direction of the connection rail, the first projecting member including a first side plane portion at an end side of the first projecting member in a width direction of the first projecting member; and a second projecting member that projects toward the gap from the second travelling plane portion in a position that does not overlap with the first projecting member in the extending direction of the connection rail in the no-guide zone, the second projecting member extending a predetermined length along the extending direction of the connection rail, the second projecting member including a second side plane portion at the end side of the second projecting member in a width direction of the second projecting member; and the position stabilizing roller supporting member is arranged at a lower side of the travelling unit, the position stabilizing roller supporting member supporting the position stabilizing rollers such that the position stabilizing rollers abut the first side plane portion and the second side plane portion.

6. The rail guided vehicle system according to claim 5, wherein the position stabilizing rollers are arranged in a line along a travelling direction of the vehicle in an area of a center portion of the lower side of the travelling unit in the width direction of the travelling unit; and the first side plane portion and the second side plane portion are separated from each other by a gap equal or substantially equal to a diameter of the position stabilizing roller in the width direction.

7. The rail guided vehicle system according to claim 2, wherein the position stabilizing roller includes a first roller member and a second roller member, the first roller member and the second roller member being attached with a gap in between in the width direction of the travelling unit; and the position stabilizing roller guide includes:

a first roller guide member extending along the extending direction in the no-guide zone, on one side of the connection rail in the width direction of the connection rail, the first roller guide member being configured to guide the first roller member; and a second roller guide member extending along the extending direction in the no-guide zone, on another side of the connection rail in the width direction of the connection rail, the second roller guide member being configured to guide the second roller member.

8. The rail guided vehicle system according to claim 7, wherein the rail is arranged on a ceiling or in the vicinity of the ceiling, the rail including a first travelling plane portion and a second travelling plane portion at both sides of the lower portion of the rail in a width direction of the rail, the first travelling plane portion and the second travelling plane portion being arranged with a gap in between;

the first roller guide member rises in a planar manner from a position closer to the gap of the first travelling plane portion of the connection rail;

the second roller guide member rises in a planar manner from a position closer to the gap of the second travelling plane portion of the connection rail; and the first roller member and the second roller member are guided by abutting the first roller guide member and the second roller guide member, respectively, from outer sides of the connection rail in the width direction of the connection rail.

9. The rail guided vehicle system according to claim 2, wherein the rail is arranged on a ceiling or in the vicinity of the ceiling, the rail including a first travelling plane portion and a second travelling plane portion at both sides of the lower portion of the rail, the rail including a gap between the first travelling plane portion and the second travelling plane portion;

the rail further including:

a first projecting member that projects toward the gap from the first travelling plane portion in the no-guide zone, the first projecting member extending a predetermined length along the extending direction of the connection rail, the first projecting member including a first side plane portion at the end side of the first projecting member in a width direction of the first projecting member; and a second projecting member that projects toward the gap from the second travelling plane portion in a position that does not overlap with the first projecting member in the extending direction of the connection rail in the no-guide zone, the second projecting member extending a predetermined length along the extending direction of the connection rail, the second projecting member including a second side plane portion at the end side of the second projecting member in a width direction of the second projecting member; and the position stabilizing roller supporting member is arranged at a lower side of the travelling unit, the position stabilizing roller supporting member supporting the position stabilizing rollers such that the position stabilizing rollers abut the first side plane portion and the second side plane portion.

10. The rail guided vehicle system according to claim 9, wherein the position stabilizing rollers are arranged in a line along a travelling direction of the vehicle in an area of a center portion of a lower side of the travelling unit in the width direction of the travelling unit; and the first side plane portion and the second side plane portion are separated from each other by a gap equal or substantially equal to a diameter of the position stabilizing roller in the width direction.

* * * * *